US006700570B2

(12) United States Patent
Tachibana et al.

(10) Patent No.: US 6,700,570 B2
(45) Date of Patent: Mar. 2, 2004

(54) IMAGE DISPLAY APPARATUS

(75) Inventors: Miyuki Tachibana, Tokyo (JP); Hiroki Iwataka, Hyogo (JP)

(73) Assignee: NEC-Mitsubishi Electric Visual Systems Corporation, Tokyo (JP)

( * ) Notice: Subject to any disclaimer, the term of this patent is extended or adjusted under 35 U.S.C. 154(b) by 25 days.

(21) Appl. No.: 09/880,851

(22) Filed: Jun. 15, 2001

(65) Prior Publication Data

US 2002/0018125 A1 Feb. 14, 2002

(30) Foreign Application Priority Data

Jun. 15, 2000 (JP) ..... P2000-179587

(51) Int. Cl.[7] ..... G09G 5/00
(52) U.S. Cl. ..... 345/213; 345/99
(58) Field of Search ..... 345/211, 212, 345/213, 204, 98, 99, 100, 690, 694, 698; 348/536, 537

(56) References Cited

U.S. PATENT DOCUMENTS 5,936,678 A * 8/1999 Hirashima ..... 348/537
6,337,682 B1 * 1/2002 Hwang ..... 345/213

FOREIGN PATENT DOCUMENTS

| | | |
|---|---|---|
| JP | 6266312 | 9/1994 |
| JP | 10149130 | 6/1998 |

* cited by examiner

*Primary Examiner*—Xiao Wu
(74) *Attorney, Agent, or Firm*—Birch, Stewart, Kolasch & Birch, LLP

(57) ABSTRACT

A difference in sampling data of continuous two pixels in a digital image signal is detected. A CPU monitors the value of an output signal and determines a control value of a control signal so as to make the difference greatest. In a sampling clock generation section, a sampling clock that is synchronous to a dot clock by a synchronous signal and the control signal is generated. When the difference becomes greatest, it is possible to sample an image signal level that is less susceptible to influences from rounding, and consequently to adjust the phase of the sampling clock without an input signal having a specific pattern.

9 Claims, 10 Drawing Sheets

IMAGE DISPLAY APPARATUS

BACKGROUND OF THE INVENTION

1. Field of the Invention

The present invention relates to an image display apparatus, such as a liquid crystal display, that converts an analog image signal outputted from a personal computer (hereinafter, referred to as PC), etc., into a digital image signal and displays the resulting image.

2. Description of the Background Art

In the case when an analog input image signal is displayed on an image display apparatus of a digital type such as a liquid crystal display apparatus and a PDP display apparatus, the analog input image signal is converted into a digital image signal through a process in an analog/digital converter (hereinafter, referred to as A/D converter). Here, in the case of the input image signal that is generated by an image-pick up tube such as a TV signal, no problem is raised; however, in the case when the input image signal is a signal that has been obtained by digital/analog converting a signal originally generated as a digital signal, such as an output signal from a PC, it is necessary to pay a special attention to a sampling clock that is used in the A/D converter.

In general, the image signal from a PC is formed by placing an image on a frame memory on a dot basis by the CPU, and the image data is read every reference clock (dot clock) and outputted. In other words, the image data is outputted in synchronism with the dot clock. For this reason, in order to reproduce the image thus formed in a faithful manner by sampling the signal of the image data, it is necessary to generate a sampling clock that has the same frequency as the dot clock and also has an appropriate phase difference from the dot clock.

FIG. 15 is a block diagram that shows a construction of an image display apparatus described in Japanese Patent Application Laid-Open No. 10-149130(1998) as one conventional example of an image display apparatus. In this Figure, reference number 11 is an A/D converter, 12 is a line memory that stores a digital image signal 101 outputted from the A/D converter 11 line by line, 13 is a CPU that carries out writing and reading controls on the line memory 12 and a control on a phase adjusting section 15, 14 is a timing generation section for generating a writing clock WCK to be sent to the line memory 12, and 15 is a phase adjusting section for generating sampling clocks 50 and 51 based upon a synchronous signal 52 that is a horizontal synchronous signal of the input signal and a control signal 30 from the CPU 13.

An analog image signal 100 is converted to a digital image signal 101 by the A/D converter 11 based upon the sampling clock signal 50 outputted from the phase adjusting section 15. Then, the digital image signal 101 is written in the line memory 12 in accordance with the writing clock WCK that is generated by the timing generation section 14 based upon the sampling clock 51.

The digital image signal 101 written in the line memory 12 is read from the line memory 12 in accordance with a readout clock RCK outputted by the CPU 13, and read by the CPU 13 as a signal 20. The CPU 13 calculates an average value of some image signal levels of digital image signals corresponding to one line that have been read, and compares this with an optimal signal level preliminarily found, and outputs the difference to the phase adjusting section 15 as a differential signal 30. Thus, the phase adjusting section 15 adjusts the phase of the sampling clocks 50 and 51 by using the differential signal 30 and the synchronous signal 52.

More specifically, an image signal, which alternately repeats, for example, an image signal level of "white" and an image signal level of "black" every pixel, is used as an analog signal 100. Therefore, in the case when, for example, an analog/digital converter 11 of 8 bits is used, the outputted digital image signal 101 is allowed to optimally repeat "255" of "white" level and "0" of "black" level for each of R, C and B alternately. Then, the CPU 13 reads from the line memory 12 only either the digital image signal of "white" level or the digital image signal of "black" level alternately written in the line memory 12, and calculates the average value of the signal levels of the "white" level or the "black" level corresponding to one line. Next, the CPU 13 compares the calculated average value with "255" or "0" that is an optimal signal level, thereby generating a differential signal 30.

Here, when the sampling clock 50 is adjusted to an optimal phase with respect to the dot clock of the analog video signal 100, the difference becomes zero; however, when it deviates from the optimal phase, the difference is not zero. For example, as illustrated in FIG. 16, in the case when the phase at the reading position of the sampling clock 50 is a, the difference is represented by A. In the same manner, when the phase at the reading position of the sampling clock 50 is b, the difference is represented by B, and when it is c, the difference is represented by C.

In the case when the difference is not zero, the CPU 13 outputs a differential signal 30 corresponding to the value of the difference to the phase adjusting section 15, thereby controlling the phase adjusting section 15 to make the difference zero. This makes it possible to adjust the phase of the sampling clock 50 to an optimal value with respect to the phase of the analog image signal 100.

As described above, in the conventional image display apparatus, the image signal, which has been preliminarily determined so as to adjust the phase of the sampling clock, for example, a signal repeating "white" and "black" alternately, needs to be inputted; therefore, the resulting problem is that it is not easy for the user to adjust the phase.

SUMMARY OF THE INVENTION

According to a first aspect of the present invention, an image display apparatus comprising an analog/digital converter for converting an analog image signal to a digital image signal by sampling the analog image signal using a sampling clock, a display means for displaying an image by using the digital image signal, differential detection means for detecting a difference in sampling data between continuous two pixels in the digital image signal, a sampling clock generation means for generating the sampling clock by using a synchronous signal of the analog image signal, and adjusting means for adjusting a phase of the sampling clock based upon the difference.

In accordance with the first aspect of the present invention, based upon the difference in the sampling data of continuous two pixels in a digital image signal, the adjusting means adjusts the phase of the sampling clock so that, when an analog image signal is derived from image data that has been stored in unit of pixel and that is read and generated every dot clock, the phase adjustment of the sampling clock is carried out without the necessity of an input signal of a specific pattern.

According to a second aspect of the present invention, the image display apparatus of the first aspect wherein the adjusting means adjusts a phase of the sampling clock so as to make the difference the greatest.

In accordance with second aspect of the present invention, the adjusting means adjusts the phase of the sample clock so as to make the difference the greatest; therefore, it is possible to sample the greatest amplitude section of the signal level that the analog image signal originally owns, and consequently to sample an image signal level that is less susceptible to influences from the rounding.

According to a third aspect of the present invention, the image display apparatus of the first aspect, wherein the adjusting means adjusts a phase of the sampling clock so as to shift to a position having an offset of 180° from a position that makes the difference the smallest.

In accordance with the third aspect of the present invention, the adjustment means adjust the phase of the sampling clock to shift to a position having an offset of 180° from the position that makes the phase of the sampling clock the smallest; therefore, it is possible to easily sample the greatest amplitude section of the signal level that the analog image signal originally owns, and consequently to sample an image signal level that is less susceptible to influences from the rounding.

According to a fourth aspect of the present invention, the image display apparatus of the first aspect, wherein the adjusting means obtains an accumulated value of the differences of a plurality of pixels in the digital image signal, and adjusts a phase of the sampling clock so as to make the resulting accumulated value the greatest.

In accordance with the fourth aspect of the present invention, the adjusting means obtains an accumulated value of differences in a plurality of pixels in a digital image signal, and adjusts the phase of the sampling clock so as to make the resulting accumulated value the greatest; therefore, it is possible to more positively adjust the phase to an optimal state as compared with a case in which only the difference in the image signal levels of certain continuous two pixels in one screen is detected.

According to a fifth aspect of the present invention, the image display apparatus of the first aspect, wherein the adjusting means obtains an accumulated value of the differences of a plurality of pixels in the digital image signal, and adjusts a phase of the sampling clock so as to shift to a position having an offset of 180° from a position that makes the difference the smallest.

In accordance with the fifth aspect of the present invention, the adjusting means obtains an accumulated value of differences in a plurality of pixels in a digital image signal, and adjusts the phase of the sampling clock to shift to a position having an offset of 180° from the position that makes the resulting accumulated value the smallest; therefore, it is possible to more positively adjust the phase to an optimal state as compared with a case in which only the difference in the image signal levels of certain continuous two pixels in one screen is detected.

According to a sixth aspect of the present invention, the image display apparatus of the fourth or fifth aspects, wherein the plurality of pixels are pixels corresponding to an entire portion of one screen.

In accordance with the sixth aspect of the present invention, the adjusting means obtains an accumulated value of differences in pixels of entire one screen in a digital image signal, and adjusts the phase of the sampling clock utilizing the resulting accumulated value; therefore, the differences can securely be obtained except the case that image signal levels of all pixels are comparable, thereby it is possible to adjust the phase to an optimal state.

According to a seventh aspect of the present invention, the image display apparatus of the first aspect, wherein, after having adjusted a phase of the sampling clock, the adjusting means regularly monitors a difference in sampling data between continuous two pixels in a specific position in one screen in the digital image signal, and upon receipt of a change in the difference after a lapse of time, re-adjusts the phase of the sampling clock based upon an amount of the change.

In accordance with the seventh aspect of the present invention, after having adjusted the phase of the sampling clock, the adjusting means regularly monitors the difference in the sampling data of continuous two pixels at a specific position in one screen in a digital image signal, and upon receipt of a change in the difference after a lapse of time, re-adjusts the phase of the sampling clock based upon the amount of change; therefore, even when, after the phase adjustment, the phase of the dot clock of the analog image signal and the phase of the sampling clock come to have an offset, the phase of the sampling clock is automatically corrected. Moreover, since it is not necessary to shift the phase of the sampling clock, no disturbance is caused on the screen. Therefore, the re-adjustment is carried out without making the user recognize the operation even when it is automatically executed while the user is using the device. Furthermore, the difference in the image signal levels between specific continuous two pixels is monitored so that the change is more sensitively recognized as compared with a case in which, for example, a change in the image signal level in a specific one pixel is monitored.

According to an eighth aspect of the present invention, the image display apparatus of the seventh aspect, wherein the continuous two pixels in the specific position are set as a pixel on an edge of an effective display area that is a range for displaying an image and a pixel that is adjacent to the pixel and located out of the effective display area.

In accordance with the eighth aspect of the present invention, a pixel on the edge of an effective display area and a pixel that is adjacent to this pixel and located out of the effective display area are set as the continuous two pixels at a specific position; therefore, those pixels that are less susceptible to changes in the image signal can be selected as the continuous two pixels in a specific position; thus, it is possible to easily discriminate whether a change in the difference is caused by a change in the inputted image signal level or a change in the phase. Therefore, it becomes possible to effectively carry out the phase adjustment even in the case of an image having no change in the signal amplitude on the entire screen.

The present invention has been devised to solve the above-mentioned problem, and its objective is to provide an image display apparatus which, upon adjusting the phase of the sampling clock at the time of the analog/digital conversion, eliminates the necessity of inputting an image signal having a specific pattern.

These and other objects, features, aspects and advantages of the present invention will become more apparent from the following detailed description of the present invention when taken in conjunction with the accompanying drawings.

DESCRIPTION OF THE PREFERRED EMBODIMENTS

<First Preferred Embodiment>

This preferred embodiment makes it possible to realize an image display apparatus which carries out a phase adjustment on the phase relationship between the sample clock and the dot clock of the analog input image signal based upon the difference in the sampling data of image signal levels of continuous two pixels so that the phase adjustment of the sampling clock is executed without the necessity of an input signal having a specific pattern.

Figure 1:
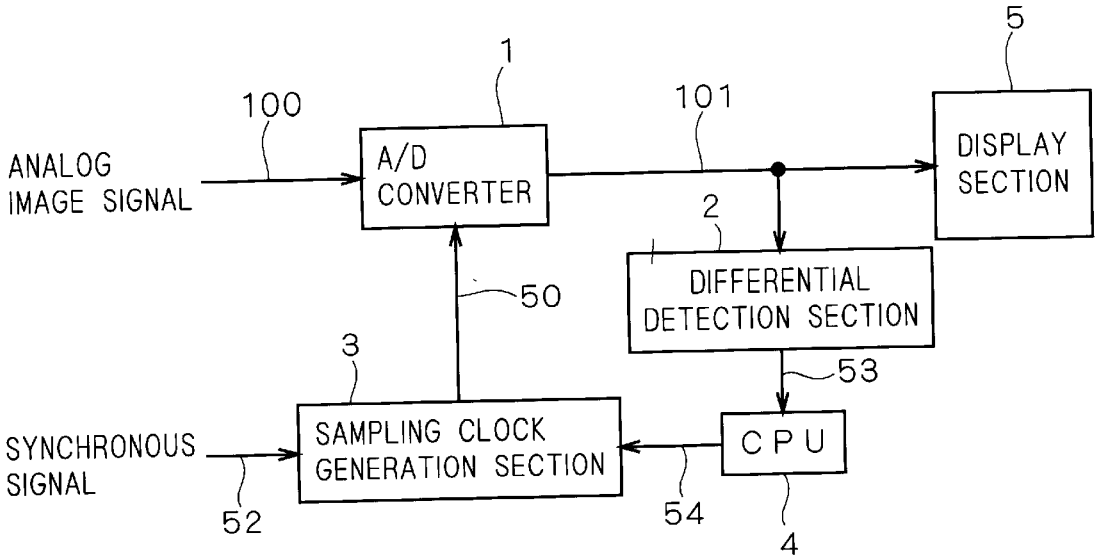
FIG. 1 is a drawing that shows the construction of an image display apparatus in accordance with a first preferred embodiment.
Figure 2:
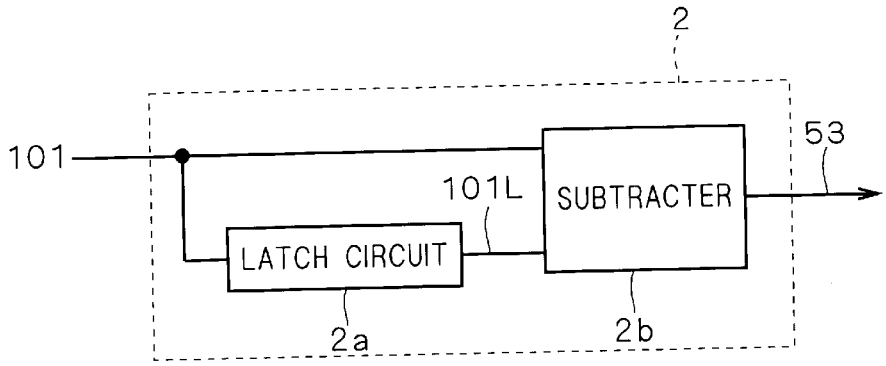
FIG. 2 is a drawing that shows the construction of a differential detection section in the image display apparatus in accordance with the first preferred embodiment.
Figure 3:
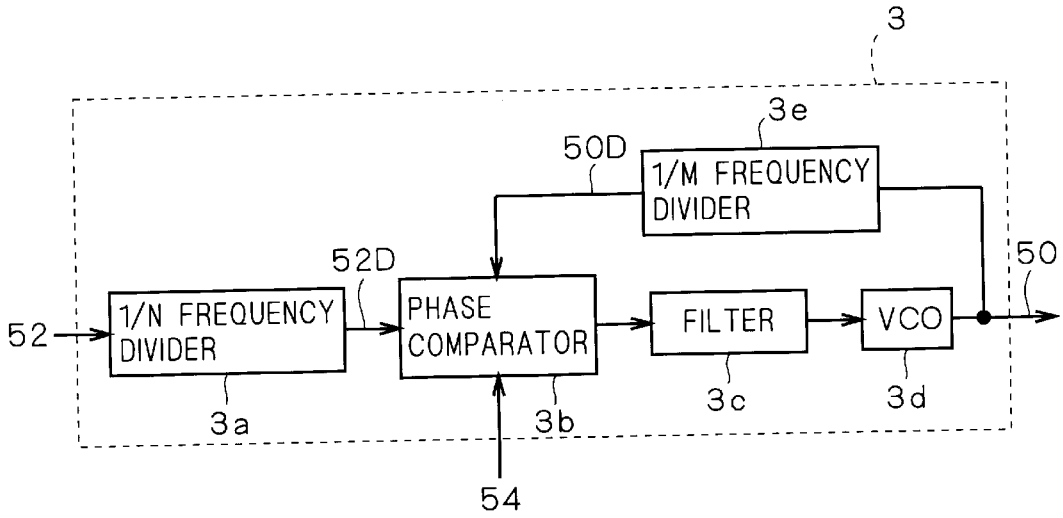
FIG. 3 is a drawing that shows the construction of a sampling clock generation section 3 in accordance with the first preferred embodiment.

Referring to FIGS. 1 to 3, the following description will discuss the construction of an image display apparatus in accordance with the present preferred embodiment. In FIG. 1, reference number 1 is an A/D converter for converting an analog image signal 100 to a digital image signal 101, 2 is a difference detection section for detecting the difference of sampling data between image signal levels of continuous two pixels in the digital image signal 101 outputted by the A/D converter 1, 3 is a sampling clock generation section for generating a sampling clock 50 that is synchronous to a dot clock used for generating the analog image signal 100, 4 is a CPU for controlling the phase of the sampling clock 50 with respect to the dot clock, and 5 is a display section of a panel such as a liquid crystal panel and a plasma display panel on which an image display is given by the digital image signal 101.

Here, the difference detection section 2 is a circuit as shown in FIG. 2. In other words, the difference detection section 2 is provided with a latch circuit 2*a* and a subtracter 2*b*, and the digital image signal 101 is inputted to the latch circuit 2*a* and either of the input terminals of the subtracter 2*b*. Then, the output 101L of the latch circuit 2*a* is inputted to the other input terminal of the subtracter 2*b*. Thus, the output 53 of the subtracter 2*b* forms an output signal to the CPU 4.

Here, the difference detection section 2 may be arranged as a hardware circuit, or may be designed as software by using the computing function of the CPU 4 and the memory inside the CPU 4.

Moreover, the sampling clock generation section 3 is a PLL (Phase Locked Loop) circuit as illustrated in FIG. 3. In other words, the sampling clock generation section 3 is provided with a 1/N frequency divider 3*a*, a phase comparator 3*b*, a filter 3*c* and a VCO (Voltage Controlled Oscillator) 3*d* and a 1/M frequency divider 3*e*. Here, a synchronous signal 52 that is a horizontal synchronous signal of the analog image signal 100 is inputted to the 1/N frequency divider 3*a*, and the output 52D of the 1/N frequency divider 3*a* and the output 50D of the 1/M frequency divider 3*e* are inputted to the phase comparator. Moreover, a control signal 54 from the CPU 4 is also inputted to the phase comparator 3*b*. The output of the phase comparator 3*b* is inputted to a filter 3*c*, and the output of the filter 3*c* is inputted to a VCO 3*d*. Then, the output of the VCO forms a sampling clock 50. Here, the sampling clock 50 is also inputted to the 1/M frequency divider 3*e*. Moreover, the values of N and M are set to predetermined values by the CPU 4 in accordance with the frequencies of, for example, the synchronous signal 52.

Next, an explanation will be given of the operation of the image display apparatus in accordance with the present preferred embodiment. In FIG. 1, first, the inputted analog image signal 100 is sampled by using the sampling clock 50 in the A/D converter 1, and converted to a digital image signal 101. Then, the digital image signal 101 is inputted to the display section 5.

Moreover, the digital image signal 101 is also inputted to the difference detection section 2. The difference detection section 2 detects the difference between sampling data of continuous two pixels in the inputted digital image signal 101. In other words, in the difference detection section 2, sampled data of the digital image signal 101 corresponding to one pixel before the present pixel of the digital image signal 101 is latched by the latch circuit 2*a*, and the corresponding latched output 101L and the sampling data of the pixel of the present digital image signal 101 are compared with each other in the subtracter 2*b* so as to find the difference. Then, the data of the difference is outputted to the CPU 4 as a differential signal 53. Here, the latch circuit 2*a* and the subtracter 2*b* are operated in predetermined synchronous timing with the sampling clock 50.

Here, while monitoring the value of the differential signal 53 in FIGS. 1 and 3, the CPU 4 determines the control value (set value) of a control signal 54 to be outputted to the sampling clock generation section 3 based upon the results of the monitoring operation. In the sampling clock generation section 3, the synchronous signal 52 is 1/N-divided in the 1/N frequency divider 3*a* to be formed into an output 52D, and the sampling clock 50 is 1/M-divided in the 1/M frequency divider 3*e* to be formed into an output 50D. Then, the phase of the output 52D and the phase of the output 50D are compared with each other in the phase comparator 3*b* so that the signal representing the results of the comparison is outputted to the filter 3*c*. Here, the signal representing the results of the comparison is further adjusted by the control signal 54 from the CPU 4.

Then, the signal representing the results of the comparison is smoothed by the filter 3*c* to form a control signal for the VCO 3*d* so that the frequency and phase of the sampling clock 50 are adjusted so as to be made synchronous to the synchronous signal 52.

Here, referring to FIGS. 4 to 6, an explanation will be given of the control of the sampling clock 50 by the CPU 4.

Figure 4:
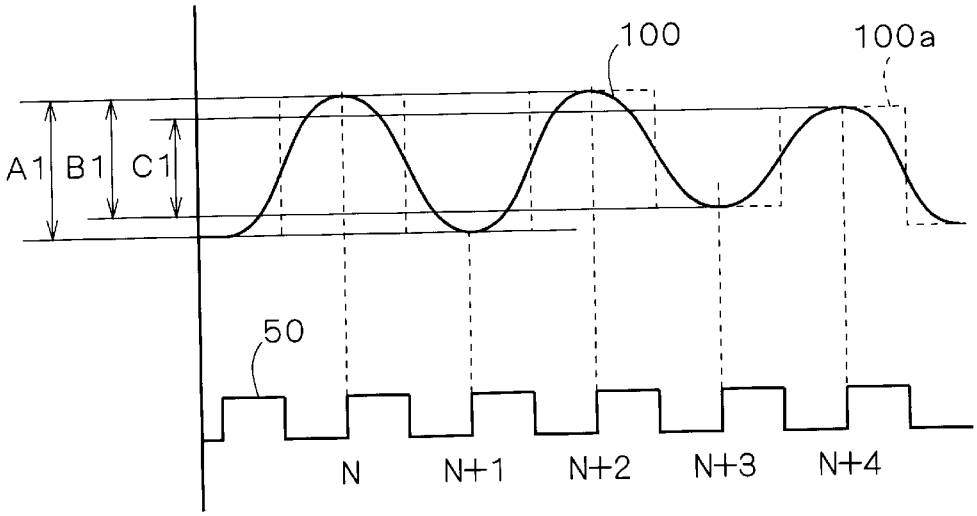
FIG. 4 is a timing chart that shows the phase relationship between an analog image signal 100 and a sampling clock 50.
Figure 5:
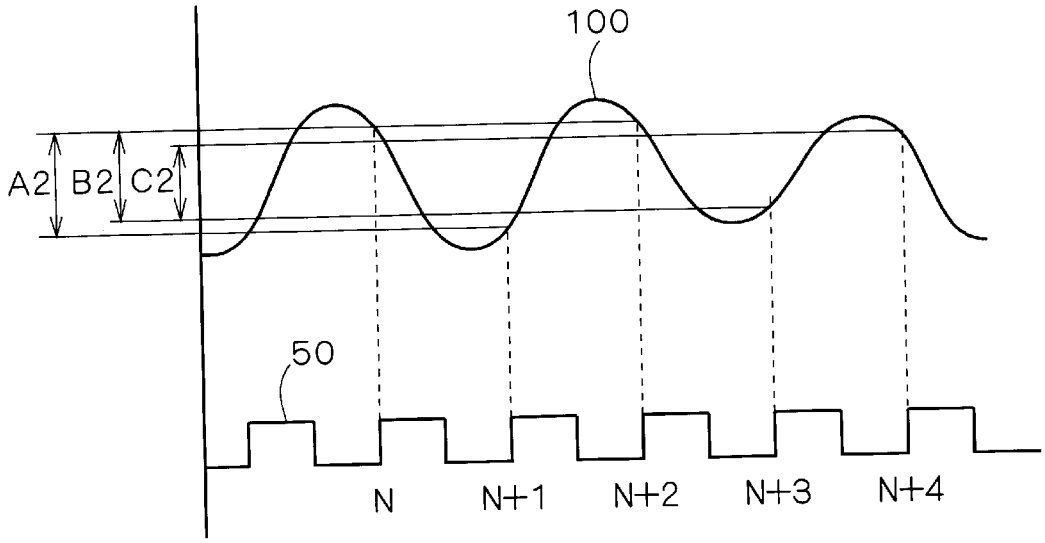
FIG. 5 is a timing chart that shows the phase relationship between the analog image signal 100 and the sampling clock 50.
Figure 6:
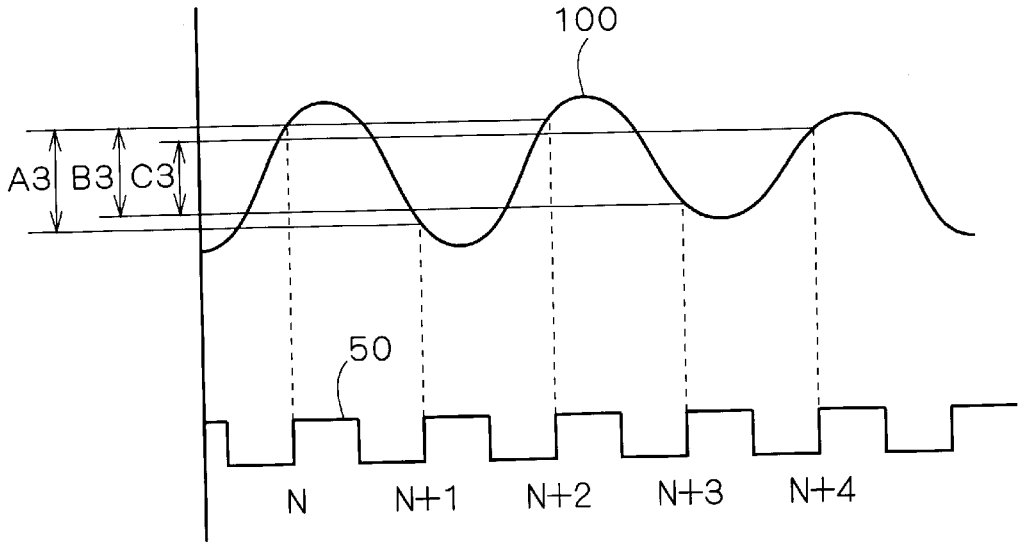
FIG. 6 is a timing chart that shows the phase relationship between the analog image signal 100 and the sampling clock 50.

In FIGS. 4 to 6, reference number 50 is a waveform of a sampling clock, and reference number 100 is a waveform of an analog image signal. The analog image signal 100 has a certain image signal level for every unit of dot clock. In this case, a waveform in which the signal intensity goes up and down alternately every pixel is given as an example of the analog image signal. Here, the analog image signal is optimally set to have a waveform 100*a* having the same level for one cycle of the dot clock; however, actually it comes to have a rounding in its wave form due to impedances in the transmission paths, thereby forming a waveform 100 whose level varies gradually as illustrated in FIG. 4.

Here, FIG. 4 shows a case in which the dot clock of the analog image signal 100 and the sampling clock 50 are in an optimal positional relationship with respect to the phase, with an offset of 180°. In this state, the greatest amplitude section of the signal level that the image signal originally owns can be sampled so that an image signal level that is less susceptible to influences from the rounding is sampled.

As illustrated in the Figure, the difference between the image signal levels of the continuous two pixels is obtained by taking a difference between image signal levels at the rising time of respective clocks, that is, N-numbered and N+1-numbered clocks, N+1-numbered and N+2-numered clocks, N+2-numbered and N+3-numbered clocks and N+3-numbered and N+4-numbered clocks of sampling clocks 50 (in this case, it is supposed that at the time of the rising of the sampling clock 50, the sampling is carried out, and the same is true in the following descriptions). In other words, with respect to the difference in the image signal levels of the continuous two pixels of the analog image signal 100, for example, the difference between the N-numbered and N+1-numbered ones and the difference between the N+1-numbered and N+2-numbered ones are represented by A1, the difference between the N+2-numbered and N+3-numbered ones is represented by B1, and the difference between the N+3-numbered and N+4-numbered ones is represented by C1.

FIG. 5 shows a case in which the phase of the sampling clock 50 further has a delay from the position with a 180° offset from the phase of the dot clock of the analog image signal 100. In this case, with respect to the difference in the image signal levels of the continuous two pixels, the difference between the N-numbered and N+1-numbered ones and the difference between the N+1-numbered and N+2-numbered ones are represented by A2, the difference between the N+2-numbered and N+3-numbered ones is represented by B2, and the difference between the N+3-numbered and N+4-numbered ones is represented by C2. Here, as clearly shown by the comparison between FIG. 4 and FIG. 5, A2<A1, B2<B1 and C2<C1 hold respectively.

Moreover, FIG. 6 shows a case in which the phase of the sampling clock 50 has an advance from the position with a 180° offset from the phase of the dot clock of the analog image signal 100. In this case, with respect to the difference in the image signal levels of the continuous two pixels, the difference between the N-numbered and N+1-numbered ones and the difference between the N+1-numbered and N+2 numbered ones are represented by A3, the difference between the N+2 numbered and N+3 numbered ones is represented by B3, and the difference between the N+3 numbered and N+4 numbered ones is represented by C3. Here, as clearly shown by the Figures, A3<A1, B3<B1 and C3<C1 hold respectively.

The above description shows that in the case when the dot clock of the analog image signal 100 and the sampling clock 50 have virtually a 180° offset in their phase relationship, the difference in the image signal levels of the continuous two pixels becomes the greatest.

Therefore, by utilizing such a property in the analog image signal outputted from a PC, etc., that is, by finding a phase difference that makes the difference in the image signal levels of the continuous two pixels the greatest in a predetermined portion in one screen, it becomes possible to sample an image signal level that is less susceptible to influences from the rounding. In other words, the CPU 4 properly changes the control signal 54 so as to change the phase of the sampling clock 50 with an offset corresponding to one cycle (±180°), and monitors the differential signal 53 outputted in the continuous two pixels that are targets in one screen; thus, the position of the phase that makes the difference in the image signal levels of the continuous two pixels the greatest is found. This operation is easily achieved by properly designing a software program by connecting a ROM, a RAM, etc. to the CPU 4.

As a result, an optimal phase difference is set between the dot clock and the sampling clock, thereby making it possible to provide an image that is faithful to an image signal outputted from a PC, etc.

Here, in the above description, for convenience of explanation, one signal is given as the analog image signal 100; however, in the case when the analog image signal 100 is a color signal, the above-mentioned process is, of course, carried out on each of the signals of R, G and B.

In accordance with the image display apparatus of the present preferred embodiment, the phase relationship is adjusted between the sampling clock and the dot clock of the analog input image signal based upon the difference in the sampling data of the image signal levels of continuous two pixels; therefore, the positional adjustment of the sampling clock can be carried out without the necessity of an input signal of a specific pattern. Moreover, since the phase position that makes the difference in the image signal levels of continuous two pixels greatest is found, it is possible to sample an image signal level that is less susceptible to influences from the rounding.

Additionally, during the period in which the phase of the sampling clock 50 is changed by the control signal 54 to find the optimal position, there is a disturbance in the displayed image; therefore, during this period, the digital image signal 101 may be subjected to a masking process (a process which prevents the signal from being outputted) to provide a black display.

<Second Preferred Embodiment>

The present preferred embodiment is a modified example of the image display device of the first preferred embodiment, in which not the phase position that makes the difference in the image signal levels of continuous two pixels the greatest, but a phase position that makes it the smallest is first found, and this phase is then allowed to have an advance or a delay of 180° so that the phase relationship between the sampling clock and the dot clock of the analog input image signal is adjusted to an optimal state.

Figure 7:
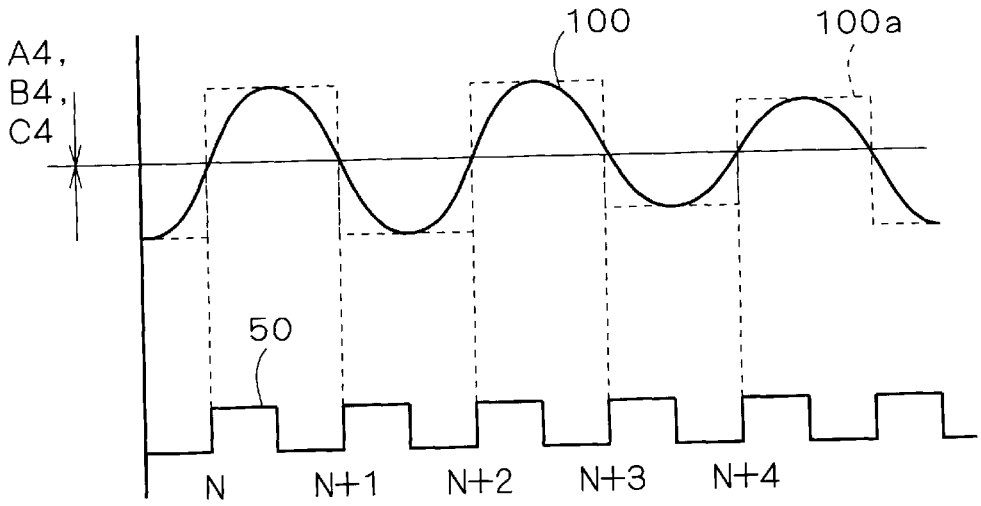
FIG. 7 is a timing chart that shows the phase relationship between the analog image signal 100 and the sampling clock 50.

Referring to FIGS. 7 to 10, an explanation will be given of an image display apparatus of the present preferred embodiment. In the same manner as the case illustrated in FIGS. 4 to 6, reference number 50 in FIGS. 7 to 10 represents a waveform of a sampling clock, and reference number 100 represents a waveform of an analog image signal. Moreover, a waveform 100*a* in FIG. 7 represents an ideal waveform of the analog image signal 100.

Here, FIG. 7 shows a case in which there is no offset between the phase of the dot clock of the analog image signal 100 and the phase of the sampling clock 50. In this case, the timing in which the analog image signal 100 is sampled is set to a position corresponding a signal control value located at just the middle of the rising or falling of the analog image signal 100. At this time, among the differences of the image signal levels of continuous two pixels of the analog image signal 100, the difference A4 between N-numbered and N+1-numbered ones as well as between N+1-numbered and N+2-numbered ones, the difference B4 between N+2-numbered and N+3-numbered ones and the difference C4 between N+3- and N+4-numbered ones are all set to 0.

Figure 8:
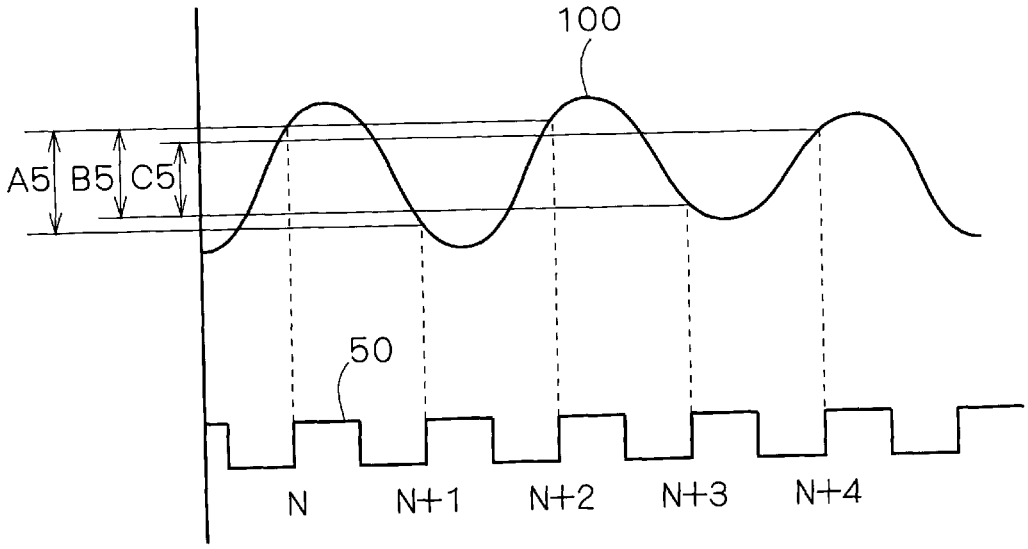
FIG. 8 is a timing chart that shows the phase relationship between the analog image signal 100 and the sampling clock 50.

FIG. 8 shows a case in which the phase of the sampling clock 50 has a delay from the phase of a dot clock of the analog image signal 100. In this case, with respect to the difference in the image signal levels of the continuous two pixels, the difference between the N-numbered and N+1-numbered ones and the difference between the N+1-numbered and N+2-numbered ones are represented by A5, the difference between the N+2-numbered and N+3-numbered ones is represented by B5, and the difference between the N+3-numbered and N+4-numbered ones is represented by C5. Here, as clearly shown by the comparison between FIGS. 7 and 8, A4<A5, B4<B5 and C4<C5 hold respectively.

Figure 9:
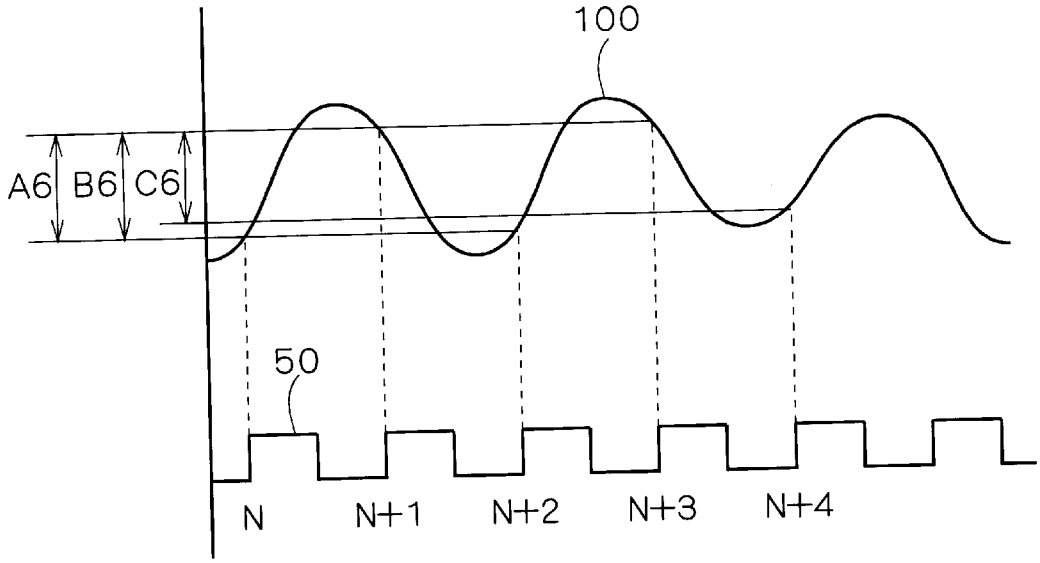
FIG. 9 is a timing chart that shows the phase relationship between the analog image signal 100 and the sampling clock 50.

Moreover, FIG. 9 shows a case in which the phase of the sampling clock 50 has an advance from the phase of a dot clock of the analog image signal 100. In this case, with respect to the difference in the image signal levels of the continuous two pixels, the difference between the N-numbered and N+1-numbered ones and the difference between the N+1-numbered and N+2-numbered ones are represented by A6, the difference between the N+2-numbered and N+3-numbered ones is represented by B6, and the difference between the N+3-numbered and N+4-numbered ones is represented by C6. In this case also, as clearly shown by the Figures, A4<A6, B4<B6 and C4<C6 hold respectively.

The above description shows that in the case when there is no offset between the phase of the dot clock of the analog image signal 100 and the phase of the sampling clock 50, the difference in the image signal levels of the continuous two pixels becomes the smallest.

Here, as clearly shown in FIG. 7, the phase which makes the difference in the image signal levels of continuous two pixels the smallest is the worst condition upon sampling the analog image signal 100. This is because the sampling is carried out in the middle of the transition of the analog image signal 100 in which the data of the analog image signal 100 has not come to exhibit its original value, resulting in a failure to sample an accurate value. Moreover, since a slight offset in the phase causes a great fluctuation in the sampling data value, this is the worst condition also from the viewpoint of stability in the sampling data.

However, from the reversed point of view, it is easy to find this point since the fluctuation in the sampling data value is great. In other words, after the phase relationship which makes the difference smallest has been easily detected, the phase of the sampling clock 50 may be shifted; thus, the phase relationship is adjusted to an optimal state.

Therefore, in the present preferred embodiment, the CPU 4 first changes the control signal 54 so as to allow the phase of the sampling clock 50 to have a shift of one cycle (±180°), and monitors the differential signal 53; thus, it is possible to find the phase difference which makes smallest the difference in the image signal levels of continuous two pixels in a predetermined portion in one screen.

Figure 10:
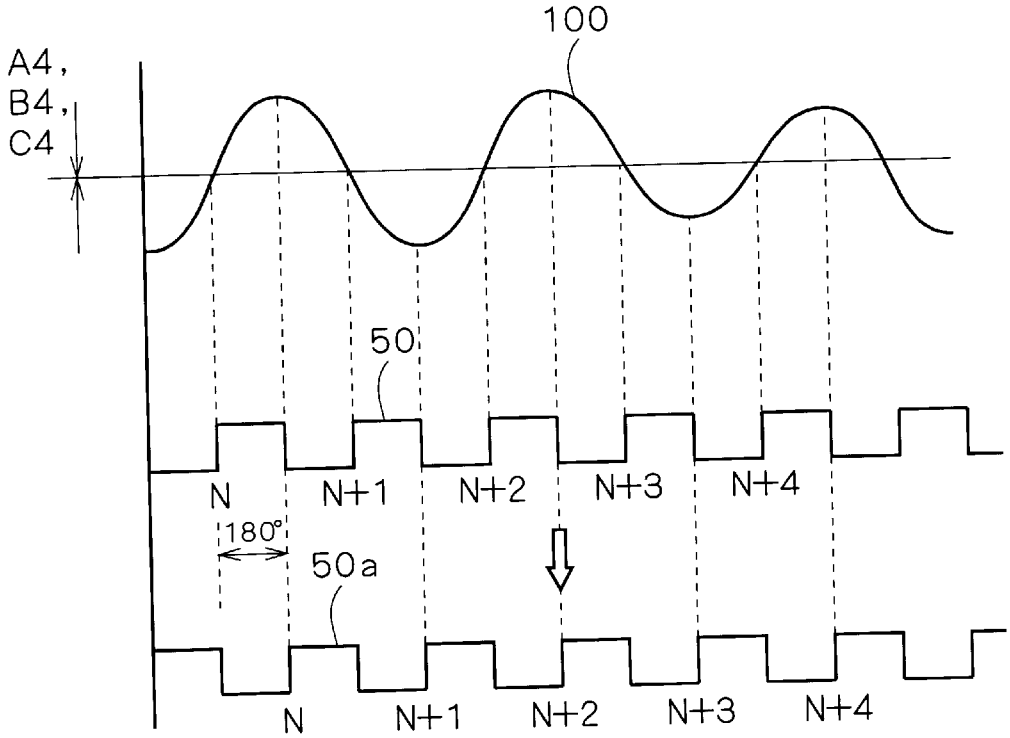
FIG. 10 is a timing chart that shows the phase relationship between the analog image signal 100 and the sampling clock 50.

Next, the CPU 4 changes the control signal 54 so that the phase of the sampling clock 50 is allowed to have an advance or a delay of 180°. Then, as illustrated in FIG. 10, a shift is made from the state of FIG. 7 to the state of FIG. 4, thereby making it possible to provide an optimal phase relationship between the sampling clock 50 and the dot clock of the analog image signal 100.

Consequently, it is possible to sample an image signal level that is less susceptible to influences from the rounding, and consequently to provide an image that is faithful to an image signal outputted from a PC, etc.

Here, in the case when the analog image signal 100 is a color signal, the above-mentioned process is, of course, carried out on each of the signals of R, G and B.

In the image display apparatus in accordance with the present preferred embodiment, after a phase position that makes the difference in the image signal levels of continuous two pixels smallest is first found, and the phase of the sampling clock 50 is then allowed to have an advance or a delay of 180°; therefore, it is possible to easily adjust the phase relationship between the sampling clock and the dot clock of the analog input image, and consequently to sample an image signal level that is less susceptible to influences from the rounding.

Additionally, during the period in which the phase of the sampling clock 50 is changed by the control signal 54 to find the position that makes the phase relationship worst, there is a disturbance in the displayed image; therefore, during this period, the digital image signal 101 may be subjected to a masking process to provide a black display in the same manner as the first preferred embodiment.

<Third Preferred Embodiment>

In the first and second preferred embodiments, explanations have been given of cases in which the phase is controlled so as to make the difference in the image signal levels of continuous two pixels in a predetermined portion of one screen the greatest or smallest; however, in actual image signals, the image signal levels of the adjacent pixels do not necessarily have different values. Supposing that the continuous two pixels have the same image signal level, the difference becomes zero, thereby making the adjustment non-convergent. In order to avoid this problem, in the image display apparatus in accordance with the present preferred embodiment, an accumulated value is obtained in the entire portions of one screen with respect to differences of the image signal levels of continuous two pixels, and the phase of the sampling clock 50 is adjusted so as to make the accumulated value the greatest or smallest. In this case, since a difference is always obtained except for the case in which the image signal levels of all the pixels are the same, it is possible to adjust the phase to an optimal state.

Figure 11:
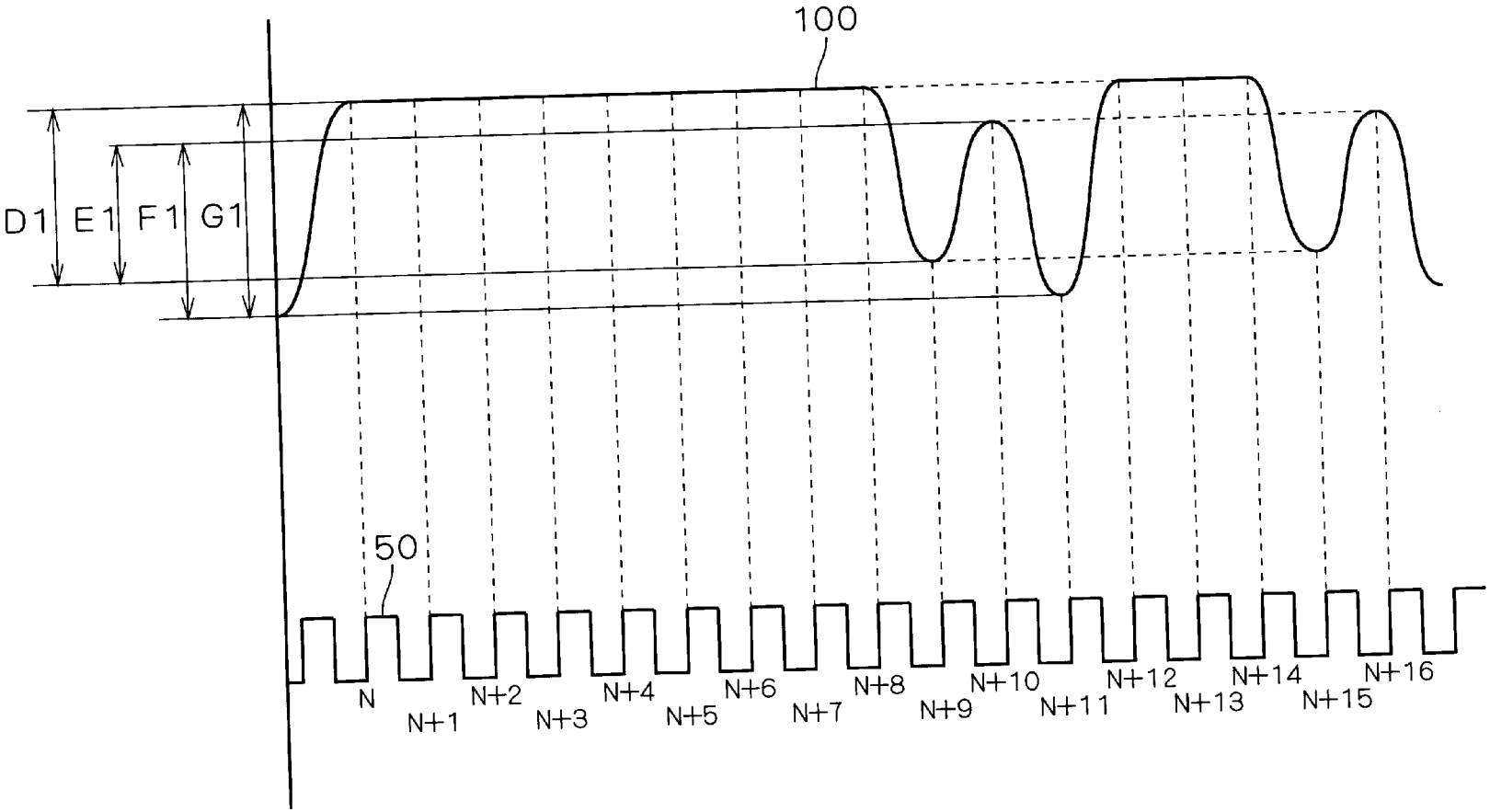
FIG. 11 is a timing chart that shows the phase relationship between the analog image signal 100 and the sampling clock 50.
Figure 12:
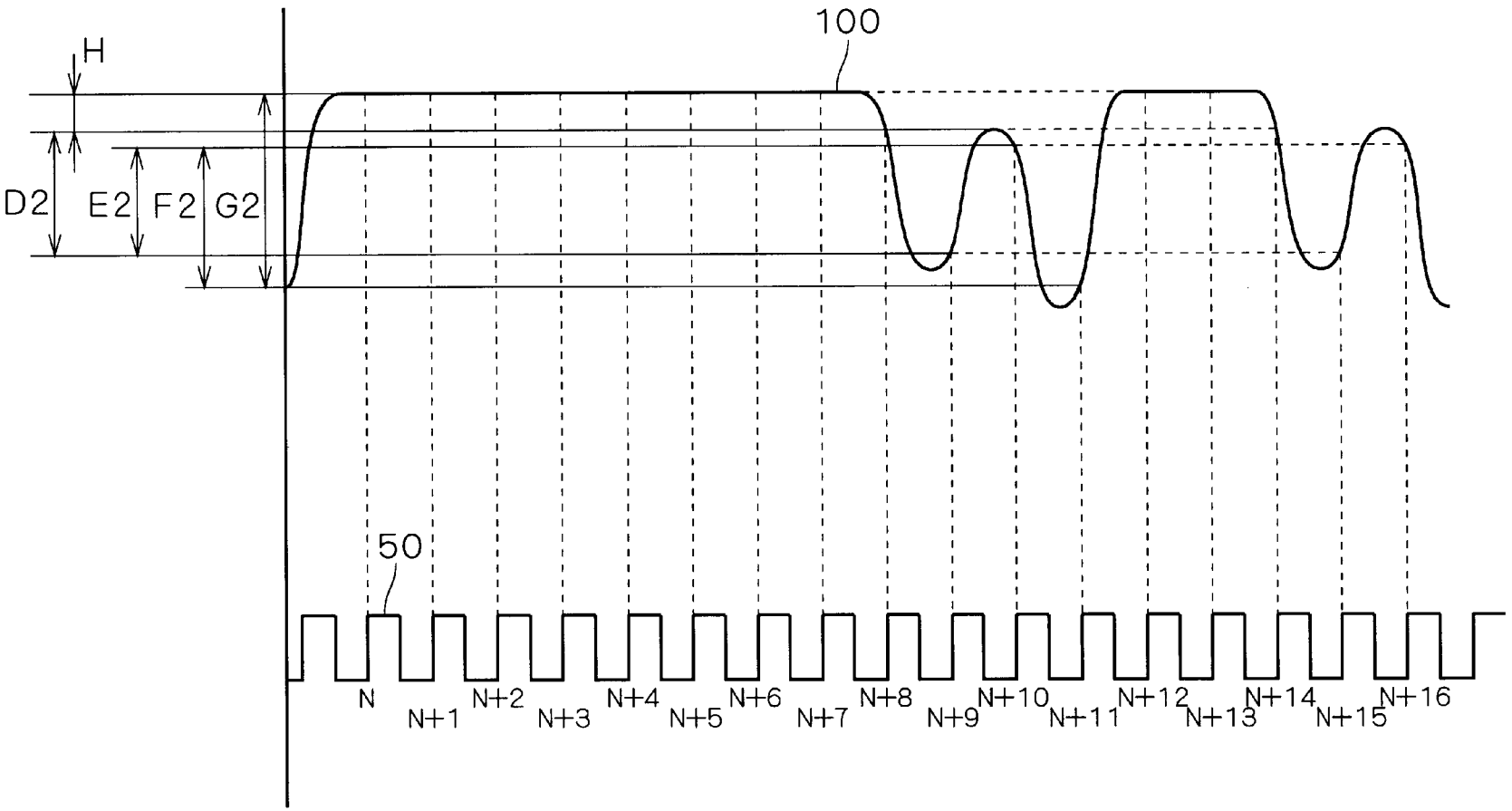
FIG. 12 is a timing chart that shows the phase relationship between the analog image signal 100 and the sampling clock 50.

Referring to FIGS. 11 and 12, an explanation will be given of an image display apparatus of the present preferred embodiment. In the same manner as the case illustrated in FIGS. 4 to 9, reference number 50 represents a waveform of a sampling clock, and reference number 100 represents a waveform of an analog image signal.

In FIG. 11 and FIG. 12, in the N-numbered to N+7-numbered ones of the sampling clock 50, the difference in the image signal levels of continuous two pixels is zero, with the result that even when the phase adjustment is carried out by using the difference of any two pixels from N-numbered to N+7-numbered ones, it is not possible to detect an optimal phase point.

In contrast, in the case when the differences of the image signal levels of adjacent pixels, for example, from N-numbered to N+16-numbered ones are accumulated, first, in FIG. 11, the difference between the N-numbered and N+1-numbered ones is zero, . . . in the same manner, the differences up to the difference between the N+7-numbered and N+8-numbered ones are zero, the difference between N+8-numbered and N+9-numbered ones is represented by D1, the difference between N+9-numbered and N+10-numbered ones is represented by E1, the difference between N+10-numbered and N+11-numbered ones is represented by F1, the difference between N+11-numbered and N+12-numbered ones is represented by G1, the differences between N+12-numbered and N+13-numbered ones as well as between N+13-numbered and N+14-numbered ones are zero, the difference between N+14-numbered and N+15-numbered ones is represented by D1, and the difference between N+15-numbered and N+16-numbered ones is E1. Therefore, the accumulated value of the differences is D1+E1+F1+G1+D1+E1.

On the other hand, in FIG. 12 in which the phase of the sampling clock 50 has a delay from the case of FIG. 11, in the same manner, the differences from difference between N-numbered and N+1-numbered ones up to the difference between the N+6-numbered and N+7-numbered ones are all zero, the difference between N+7-numbered and N+8-numbered ones is represented by H, the difference between N+8-numbered and N+9-numbered ones is represented by D2, the difference between N+9-numbered and N+10-numbered ones is represented by E2, the difference between N+10-numbered and N+11-numbered ones is represented by F2, the difference between N+11-numbered and N+12-numbered ones is G2, the difference between N+12-numbered and N+13-numbered ones is zero, the differences between N+13-numbered and N+14-numbered ones is H, the difference between N+14-numbered and N+15-numbered ones is represented by D2, and the difference between N+15-numbered and N+16-numbered ones is E2. Therefore, in this case, the accumulated value of the differences is H+D2+E2+F2+G2 +H+D2+E2.

Here, as clearly shown by the comparison between FIG. 11 and FIG. 12, H+D2<D1, E2<E1, F2<F1 and G2<G1 hold; therefore, H+D2+E2+F2+G2+H+D2+E2<D1+E1+F1+G1+D1+E1 hold. In other words, in the accumulated value of the differences also, by finding a phase difference that provides the greatest value, it becomes possible to sample an image signal level that is less susceptible to influences from the rounding.

Although not shown in the Figures, in the case when the phase of the sampling clock 50 has an advanced phase, the accumulated value becomes smaller in the same manner.

In the present preferred embodiment, the CPU 4 is allowed to have a function for accumulating differential data corresponding to one screen by connecting a buffer memory, etc., thereto. More specifically, based upon the differential signal 53 that has been successively outputted by the differential detection section 2 with respect to one screen, the CPU 4 accumulates the differential data corresponding to one screen. Then, the CPU 4 changes the control signal 54 so as to allow the phase of the sampling clock 50 to have a shift of one cycle (±180°), and monitors the accumulated value of the differential signal 53; thus, it is possible to find a phase position which makes greatest the accumulated value of differences of the image signal levels of continuous two pixels.

Consequently, it becomes possible to set an optimal phase difference between the dot clock and the sampling clock, and consequently to obtain an image that is faithful to a signal outputted by the PC.

Here, in the case when, not limited to the differential data corresponding to one screen, differential data is accumulated with respect to a plurality of pixels, the same effects as described above are obtained as long as there is any change in the intensity of the signals within the plurality of pixels. In this case, the place at which the plurality of pixels are sampled for differential data is desirably set to, for example, any one line, any plurality of lines or a plurality of pixels at any place, and the setting is carried out by the CPU 4.

In this preferred embodiment, an explanation has been given of a case in which a point that makes the accumulated value of differences greatest is directly found; however, as described in the second preferred embodiment, after a point which makes the accumulated value of differences smallest has been found, the phase of the sampling clock 50 is then allowed to have an advance or a delay of 180°. In this case also, the same effects as the second preferred embodiment are obtained.

Here, in the case when the analog image signal 100 is a color signal, the above-mentioned process is, of course, carried out on each of the signals of R, G and B.

In the image display apparatus in accordance with the present preferred embodiment, an accumulated value of differences of the image signal levels of continuous two pixels is obtained with respect to the entire portion of one screen, and the phase of the sampling clock 50 is adjusted so as to make the accumulated value the greatest or smallest; therefore, as compared with a case in which only the difference in the image signal levels of any of continuous two pixels in one screen, it is possible to more preferably adjust the phase to a better state.

Additionally, during the period in which the phase of the sampling clock 50 is changed by the control signal 54, there is a disturbance in the displayed image; therefore, during this period, the digital video signal 101 may be subjected to a masking process to provide a black display in the same manner as the first preferred embodiment.

<Fourth Preferred Embodiment>

This preferred embodiment provides an image display apparatus that can automatically adjust a phase offset between the phase of the dot clock of the analog image signal 100 and the phase of the sampling clock 50 when it occurs after the phase adjustment.

In the above-mentioned first to third preferred embodiments, during the processes of the phase adjustment, after the phase of the sampling clock 50 has been shifted by (±180°), the optimal point is then found. For this reason, during this adjustment period, that is a disturbance in the screen. In the case when, for example, this adjustment is manually carried out by the user, or in the case when, even upon automatic adjustment, the phase adjustment operation is repeated from the beginning after the inputted analog image signal has been switched to new one, no problem is raised because the user takes the disturbance on the screen for granted.

Here, the phase of the dot clock of the input analog image signal 100 and the phase of the sampling clock 50 sometimes change with time. For example, it is difficult to make the cycle of the dot clock of the input analog image signal 100 and the cycle of the sampling clock 50 completely coincident with each other, and errors tend to accumulate as the time elapses, causing an offset in the phases. Moreover, besides this, the phases tend to have an offset due to changes in the ambient temperature of the circuits.

In an attempt to make a re-adjustment to such changes with time, the above-mentioned disturbance on the screen raises a problem, with the result that the methods of the first to third preferred embodiments are not applicable. Here, the image display apparatus of the present preferred embodiment makes it possible to adjust the phases without making the user recognize the adjustment, even in the case of phase changes with time.

Figure 13:
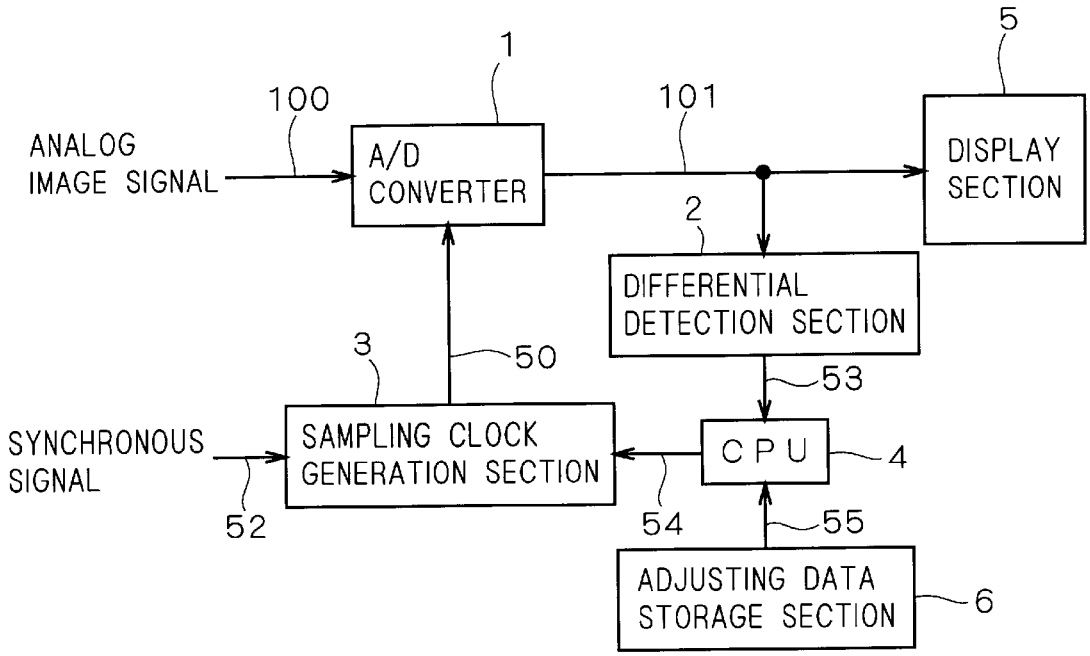
FIG. 13 is a drawing that shows an image display apparatus in accordance with a fourth preferred embodiment.

FIG. 13 is a block diagram that shows an image display apparatus in accordance with the present preferred embodiment. In this case, in addition to the constituent elements of FIG. 1, an adjusting data storage section 6 is added thereto.

In the present preferred embodiment, after completion of any one of the phase adjustments shown in the first to third preferred embodiments, the CPU 4 monitors any difference in the image signal levels of two pixels with respect to continuous two pixels in a predetermined position in one screen, in a fixed cycle, for example, every third frame. Then, upon receipt of a change in the difference due to changes with time in the phase of the dot clock of the analog image signal 100 and the phase of the sampling clock 50, the CPU 4 corrects the phase of the sampling clock 50 by using the amount of phase correction corresponding to the amount of change in the difference.

Here, the amount of phase correction corresponding to the amount of change in the difference refers to an amount of phase correction that functions so as to cancel the amount of change in the difference that is caused by changes with time due to changes in the ambient temperature and errors between the dot clock and sampling clock.

The amount of phase correction corresponding to the amount of change in the difference has been preliminarily found through repeated experiments and simulations and the results are stored in the adjustment data storage section 6 as corresponding data for each amount of change in the difference. Then, upon receipt of a change in the difference, the CPU 4 receives this as the data of the amount of phase correction 55 from the adjustment data storage section 6. In this manner, the detection is made as to whether or not the results of monitoring show any change from the differential value that has been stored immediately before in a predetermined cycle; thus, it becomes possible to carry out an automatic phase adjusting process.

Figure 14:
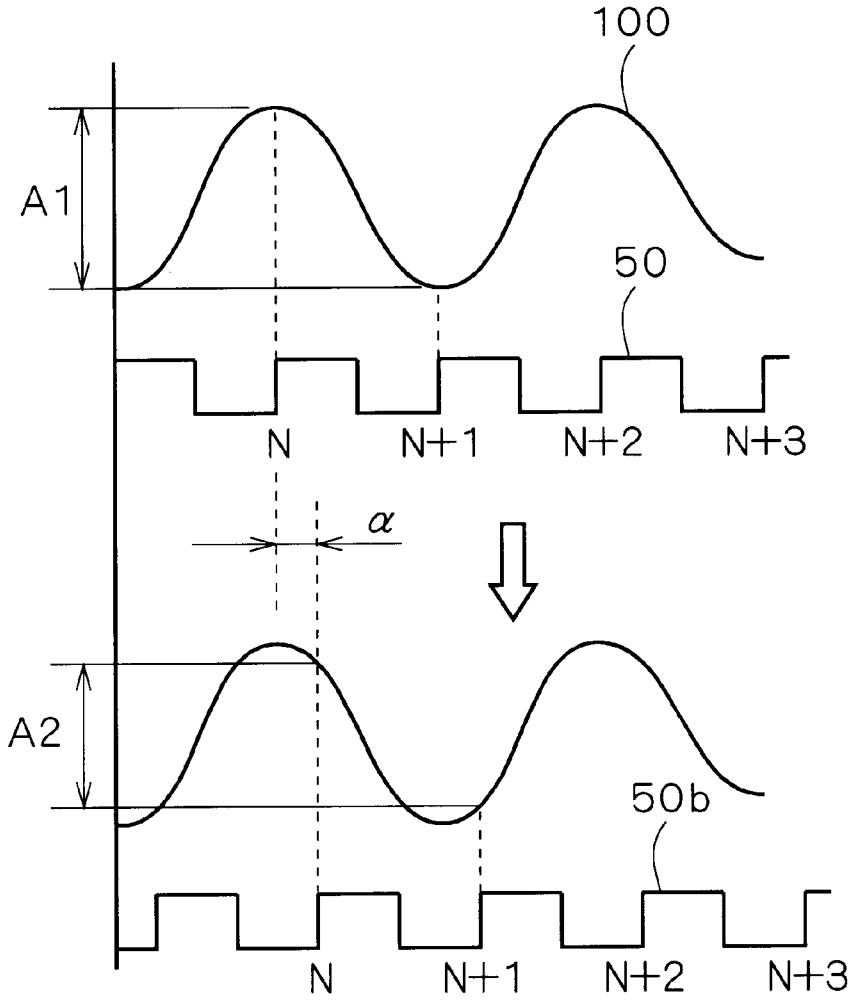
FIG. 14 is a timing chart that shows the phase relationship between the analog image signal 100 and the sampling clock 50.
Figure 15:
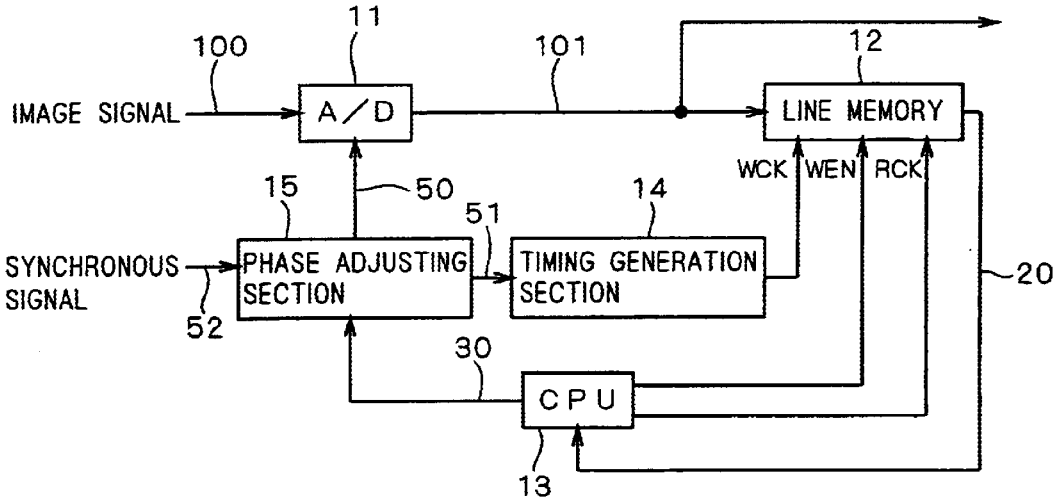
FIG. 15 PRIOR ART
FIG. 15 is a drawing that shows a conventional image display apparatus.
Figure 16:
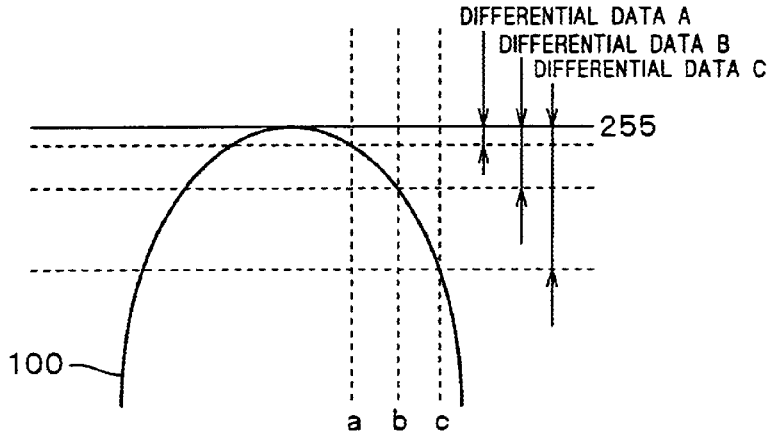
FIG. 16 PRIOR ART
FIG. 16 is a drawing that shows the phase relationship between an analog digital signal 100 and a sampling clock and differential data in the conventional image display apparatus.

For example, as shown in FIG. 14, suppose that the phase of the sampling clock 50 comes to have a delay of $\alpha$ with its waveform changed to a waveform 50*b*, after a lapse of time. In this case, supposing that the monitoring is carried out on the N-numbered and N+1-numbered pixels as the continuous two pixels in a specific position of one screen, the difference in the image signal levels is changed from A1 to A2. After detecting this amount of change $\beta$ in the difference (=A1−A2), the CPU 4 reads out the data of the amount of phase correction 55 corresponding to the amount of change from the adjustment data storage section 6 to control the sampling clock generation section 3 so that the phase of the waveform 50*b* is allowed to have an advance corresponding to cc to be returned to the original state. As a result, the phase relationship between the sampling clock 50 and the dot clock of the analog image signal 100 is returned to virtually an appropriate relationship.

Here, in some cases, depending on the contents of the analog image signal, the change in the difference in the continuous two pixels that have been monitored is derived not from the change in the phases, but simply from a level change in the inputted image signal. In such a case, the resulting problem is that it is difficult to discriminate this change from the change in the phase with time.

In order to avoid this problem, with respect to the continuous two pixels that are monitored, those that are less susceptible to a change in the image signal may be selected. For example, a pixel located on the edge of an effective display area for displaying an image and a pixel that is adjacent to this pixel and located out of the effective display area are selected. The reason for this selection is that the pixel out of the effective display area is located in a non-display portion, and normally has no data, that is, has a constant value of zero, and that the edge of the effective display area is a portion that is less susceptible to changes in data in the window display that is mainly used in recent PCs. Moreover, the selection of a pixel located on the edge of an effective display area and a pixel that is adjacent to this pixel and located out of the effective display area makes it possible to effectively carry out the phase adjustment even in the case of an image having no change in the signal amplitude on the entire screen (for example, an image consisting of entirely white portions that is less susceptible to the occurrence of differences).

In accordance with the image display apparatus of the present preferred embodiment, the adjustment data storage section 6, which stores data of the amount of phase correction for each amount of change in the difference, is prepared, and even when, after the phase adjustment, the phase of the dot clock of the analog image signal 100 and the phase of the sampling clock 50 come to have an offset, the CPU 4 automatically adjusts the phase of the sampling clock 50 by using the data of the amount of phase correction corresponding to the amount of change in the difference. Thus, since it is not necessary to shift the phase of the sampling clock 50, no disturbance is caused on the screen. Therefore, the re-adjustment is carried out without making the user recognize the operation even when it is automatically executed while the user is using the device.

Here, as described in the present preferred embodiment, the CPU 4 is designed to monitor the difference in the image signal levels between specific continuous two pixels so that the change is more sensitively recognized as compared with a case in which, for example, a change in the image signal level in a specific one pixel is monitored. This is because the change in the image signal level of the two pixels is reflected to the difference. For example, in FIG. 14, in the case of monitoring only the change in the image signal level of either the N-numbered pixel or the N+1-numbered pixel, the detection is sometimes difficult when the change is small; however, the change in the difference from A1 to A2 contains both of the change in the image signal level of the N-numbered pixel and the change in the image signal level of the N+1-numbered pixel. Therefore, the detection of the difference in the image signal levels between specific continuous two pixels makes it possible to more sensitively recognize the change in the phase with time.

While the invention has been shown and described in detail, the foregoing description is in all aspects illustrative and not restrictive. It is therefore understood that numerous other modifications and variations can be devised without departing from the scope of the invention.

What is claimed is:

1. An image display apparatus comprising:

an analog/digital converter for converting an analog image signal to a digital image signal by sampling said analog image signal using a sampling clock;

display means for displaying an image by using said digital image signal;

differential detection means for detecting a difference in sampling data between continuous two pixels in said digital image signal;

sampling clock generation means for generating said sampling clock by using a synchronous signal of said analog image signal; and adjusting means for adjusting a phase of said sampling clock based upon said difference.

2. The image display apparatus according to claim 1, wherein said adjusting means adjusts a phase of said sampling clock so as to make said difference the greatest.

3. The image display apparatus according to claim 1, wherein said adjusting means adjusts a phase of said sampling clock so as to shift to a position having an offset of 180° from a position that makes said difference the smallest.

4. The image display apparatus according to claim 1, wherein said adjusting means obtains an accumulated value of said differences of a plurality of pixels in said digital image signal, and adjusts a phase of said sampling clock so as to make said resulting accumulated value the greatest.

5. The image display apparatus according to claim 4, wherein said plurality of pixels are pixels corresponding to an entire portion of one screen.

6. The image display apparatus according to claim 1, wherein said adjusting means obtains an accumulated value of said differences of a plurality of pixels in said digital image signal, and adjusts a phase of said sampling clock so as to shift to a position having an offset of 180° from a position that makes said difference the smallest.

7. The image display apparatus according to claim 6, wherein said plurality of pixels are pixels corresponding to an entire portion of one screen.

8. The image display apparatus according to claim 1, wherein, after having adjusted a phase of said sampling clock, said adjusting means regularly monitors a difference in sampling data between continuous two pixels in a specific position in one screen in said digital image signal, and upon receipt of a change in said difference after a lapse of time, re-adjusts said phase of said sampling clock based upon an amount of said change.

9. The image display apparatus according to claim 8, wherein said continuous two pixels in said specific position are set as a pixel on an edge of an effective display area that is a range for displaying an image and a pixel that is adjacent to said pixel and located out of said effective display area.

* * * * *